United States Patent [19]

Carrens

[11] Patent Number: 4,925,374

[45] Date of Patent: May 15, 1990

[54] DOWN HOLE HYDRAULICALLY ACTUATED PUMP

[76] Inventor: Donald E. Carrens, 5912 S. Richmond, Tulsa, Okla. 74135

[21] Appl. No.: 294,807

[22] Filed: Jan. 9, 1989

[51] Int. Cl.[5] ..... F04B 47/08

[52] U.S. Cl. ..... 417/403

[58] Field of Search ..... 417/401, 403, 404

[56] References Cited

U.S. PATENT DOCUMENTS

| | | | |
|---|---|---|---|
| 2,631,541 | 3/1953 | Dempsey | 417/403 |
| 2,921,531 | 1/1960 | Brennan et al. | 417/403 |
| 2,949,857 | 8/1960 | Coberly | 417/393 X |
| 3,109,379 | 11/1963 | English | 417/403 X |
| 3,118,382 | 1/1964 | English | 417/403 |
| 3,502,028 | 3/1970 | Cooper | 417/404 |
| 3,865,516 | 2/1975 | Roeder | 417/403 |

*Primary Examiner*—Leonard E. Smith

*Attorney, Agent, or Firm*—Head & Johnson

[57] ABSTRACT

A sub-surface hydraulically operated engine for reciprocating an oilwell pumping unit includes confined hydraulic fluid means for actuating a reversing valve and its lifter in order to change the upstroke motion to downstroke motion and vice-versa.

18 Claims, 10 Drawing Sheets

DOWN HOLE HYDRAULICALLY ACTUATED PUMP

BACKGROUND

This invention relates to improvements in subsurface hydraulically operated pump assemblies as used in pumping fluid from subterranean formations. The prior art is saturated with subsurface hydraulic pumps frequently used to pump subterranean formations, e.g., oil wells. Typically a hydraulic pump assembly is suspended from or seated at the lower end of a string of power fluid supply tubing, commonly known as the power or macaroni string which is within either a larger string of production tubing or a well casing. The pumping unit is usually seated at its lower end in a seating nipple or shoe in the larger string of tubing in such a manner that the lower, pumping, end of the hydraulic pumping unit will communicate with produced fluid standing in the well. Power fluid is supplied through the macaroni string to the hydraulic actuated engine which in turn actuates the mechanics of the pumping unit utilized to force well fluids upwardly through the annulus between the macaroni string and the well tubing. The key to the reciprocating action of the engine is a reversing valve, which causes the reversal of a power actuated piston to create upstroke and downstroke cycles. The reversing mechanisms usually involve fluid pressure operated metal-to-metal shut-off. Because of the hydraulic pressure involved, impact and shock stresses have been found to be caused on the component parts especially where metal-to-metal valve seating is involved. Such valves include seat on seat and spool valve types.

SUMMARY OF THE INVENTION

A basic object of the invention is to provide a hydraulically actuated engine reversing valve capable of actuating single engine hydraulic pumps or tandem engine pumps.

Another object of the present invention is to provide a hydraulic actuated pump assembly which utilizes a reversing valve that is hydraulically cushioned to prevent undue metal on metal impact stresses.

It is a still further and important object of the invention to provide a down hole hydraulic actuated pump reversing valve assembly that is capable of operation in relatively unclean power fluid which otherwise has been known to interfere with the functioning of the prior art reversing valves.

Another object of the invention is an improvement in hydraulic actuated engines for use with a variety of reciprocating pumps including but not limited to bottom discharge or so-called "free type" subsurface hydraulic pumps.

Specifically the invention is directed to a hydraulic power fluid actuated engine for reciprocating an oil well pump. The pump is of the typical type having a reciprocatable pump piston with sufficient valve control for the inflow and outflow of the produced oil well fluid. The hydraulic engine is comprised of a power fluid supply tubing within which an engine cylinder is seated. A power piston is reciprocatable within the engine cylinder with the piston having a downstroke flow passageway and accompanying valve seat and also an upstroke exhaust flow passageway and accompanying valve seat. Flow through both passageways is controlled by a reversing valve. A hollow rod means connects the bottom of the power piston with the top of the oil well pump piston. The interior of the rod provides communication with the upstroke and downstroke internal passageways. A port means is provided above the pump piston at the lower end of the rod for exhausting spent power fluid.

A key aspect of the invention is a reciprocable reversing valve operating substantially within a section and as a part of the power piston which has an upper valve and seat means near its top end to shut-off or open the flow of power fluid through what is defined herein as a "downstroke flow passageway" with a lower valve and seat means near the bottom end of the section to respectively open and permit flow through or close an "upstroke exhaust flow passageway".

An orificed sleeve is reciprocably positioned in an orifice keeper above the upper valve seat and below a confinable cylindrical space. The sleeve being adapted to abut against the top end of the reversing valve. A fixed shift rod is suspended from the top of the power cylinder and is adapted to be axially received with the confined cylindrical space of the orifice keeper as the power piston approaches the top of its upstroke. The end of the shift rod as it enters the confined cylindrical space creates a hydraulic cushion and force effect against the orifice sleeve and the reversing valve to thereby shift and unseat the upper valve seat, thereby opening the downstroke flow passage, and seat the lower valve seat to thereby close the upstroke exhaust flow passageway whereby power fluids is now pressured against the top of the power piston driving it downward.

Below the reversing valve is a cylindrical valve lifter reciprocable within a lower cylinder. A port is provided for communicating the high pressure power fluid with the bottom of the valve lifter. Above the valve lifter port is an enlarged portion which nearing the end of the downstroke enters a close tolerance cylinder formed as a part of the power tubing which essentially shuts off flow of power fluid to the downstroke flow passageway. Because the valve lifter port is still in communication with the high pressure power fluid the valve lifter raises the reversing valve to open the lower valve and seat means and hence the upstroke exhaust flow passage and close the upper valve and seat means and hence the downstroke flow passage. High pressure power fluid now acts against the underside of the piston to create the upstroke where the cycle is repeated. Means are provided, at the surface, to provide power fluid through the supply tubing into communication with the cylinder below the power piston.

DESCRIPTION OF THE PREFERRED EMBODIMENT

Figures 1A, 1B:
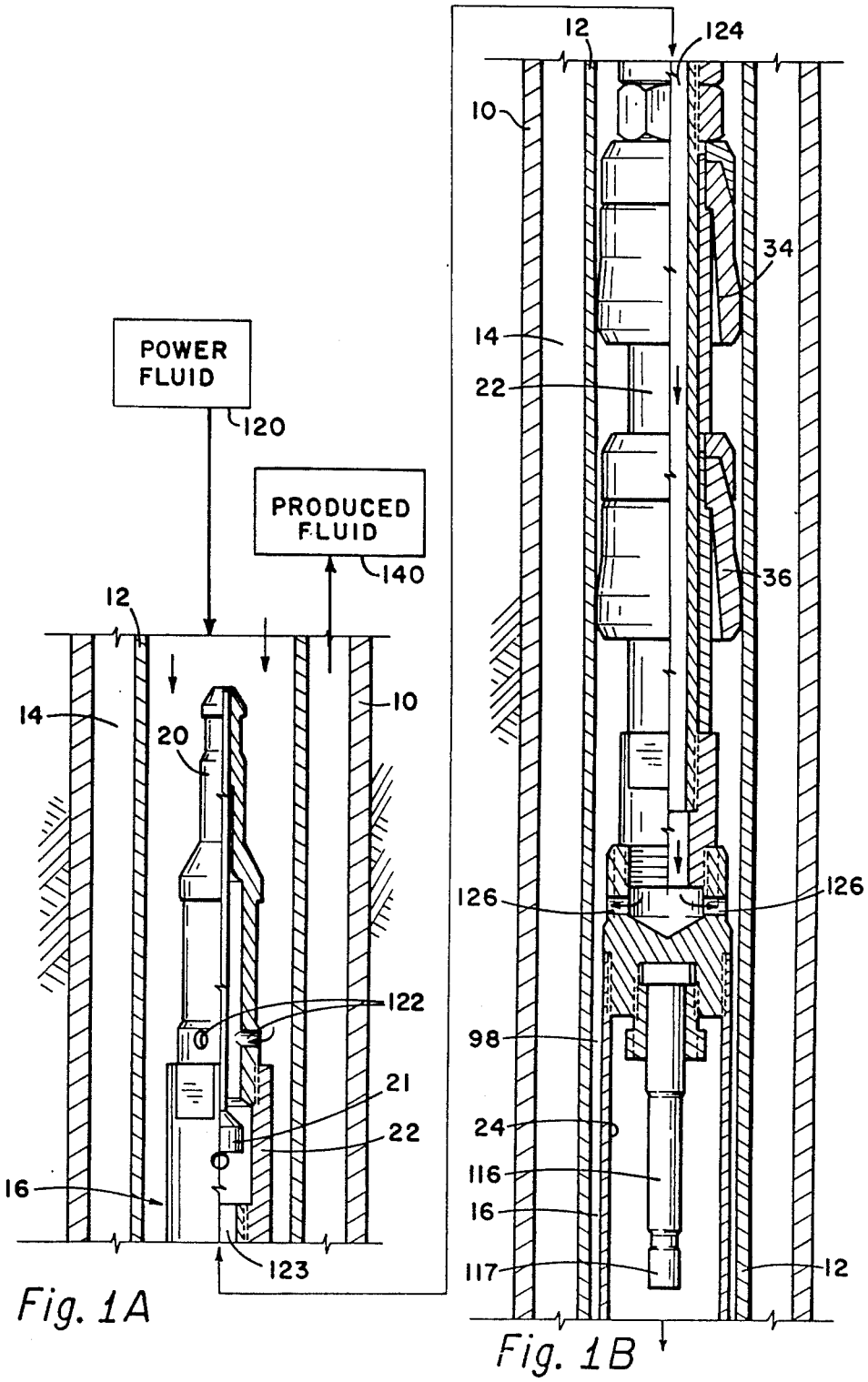
FIG. 1A through 1F are a partial cross sectional representation of the hydraulic down hole pump of this invention with the reversing valve in the upstroke position.
Figure 1C:
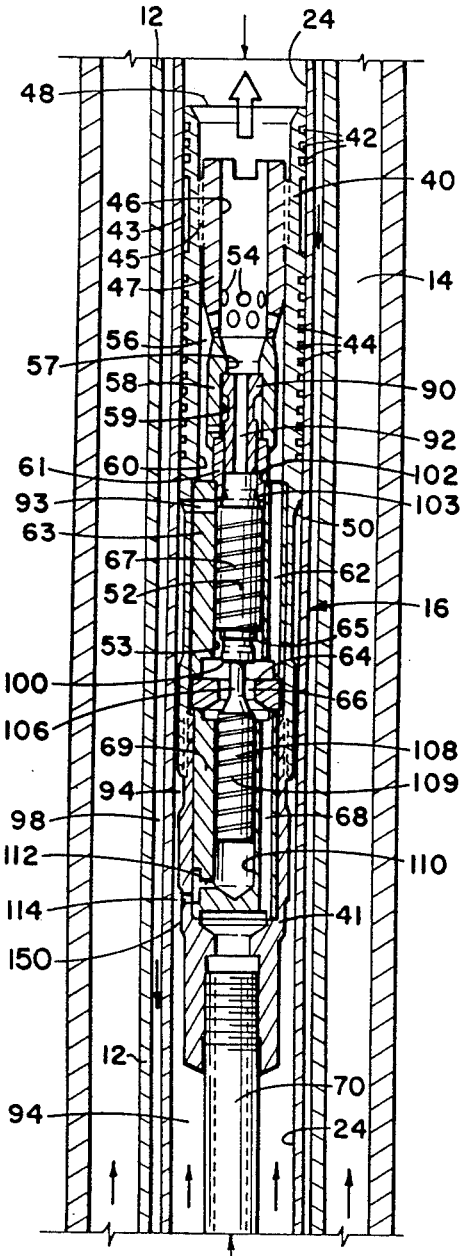
Figure 1D:
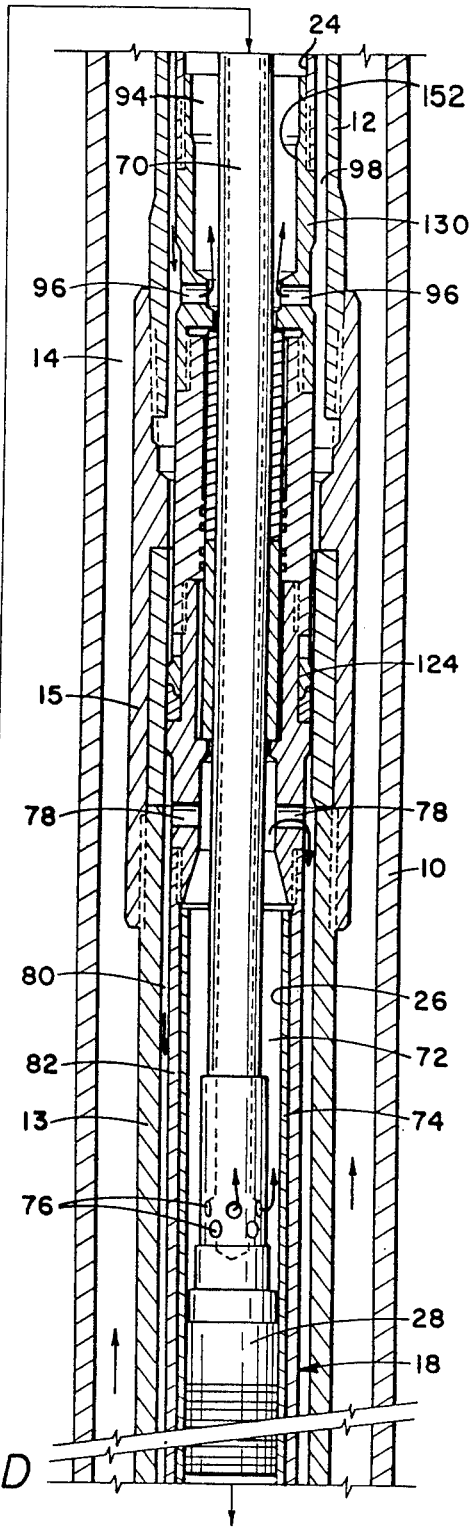

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Referring now to FIGS. 1A–1F, the apparatus is described in its position for the upstroke cycle. Production well casing 10 is provided within the oil well along with power fluid supply tubing 12 creating an annular space 14 for flow of the fluid produced from the subterranean oil well formation. Typically, and not shown, the produced fluid 140, which includes spent or exhaust power fluid, flows from the wellhead where a portion that is to be retained for power fluid use may be degassed, filtered, and returned to a power fluid pump 120 for recycle back down in to the tubing 12.

There are the two basic components of the invention, i.e., the engine generally designated by the numeral 16 and the oil well pump generally designated by the numeral 18. Although the invention is directed to any pump system where hydraulic actuated reciprocating motion is required, it is particularly operative with free type or fixed pump systems.

Figure 1E:
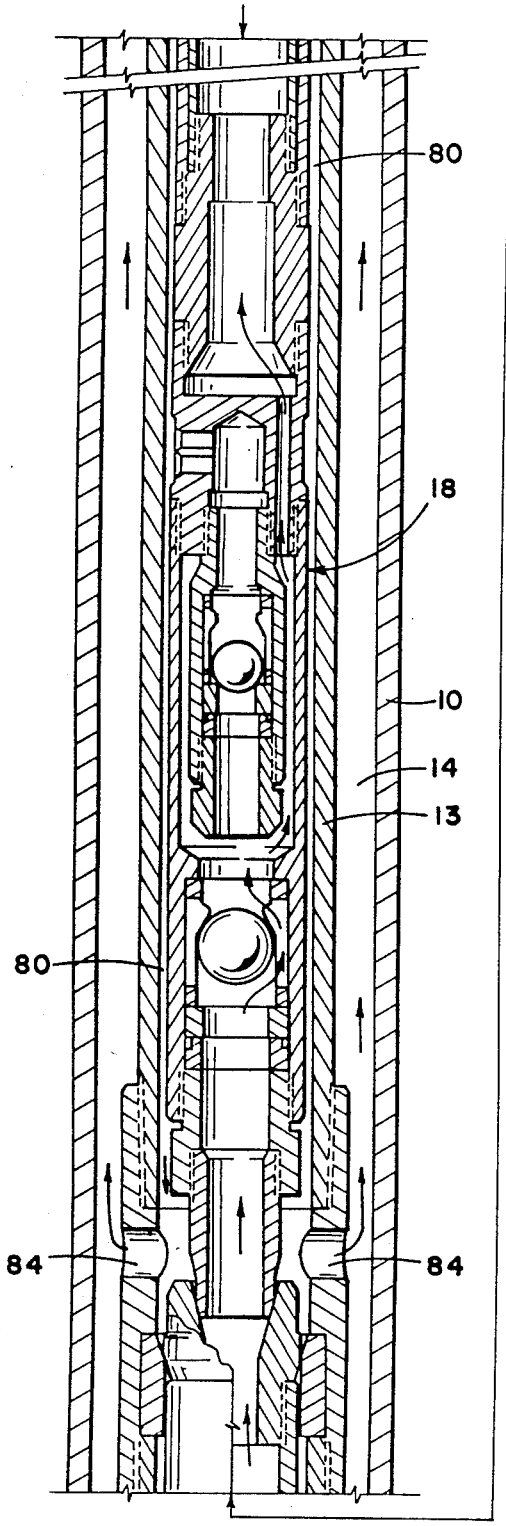
Figure 1F:
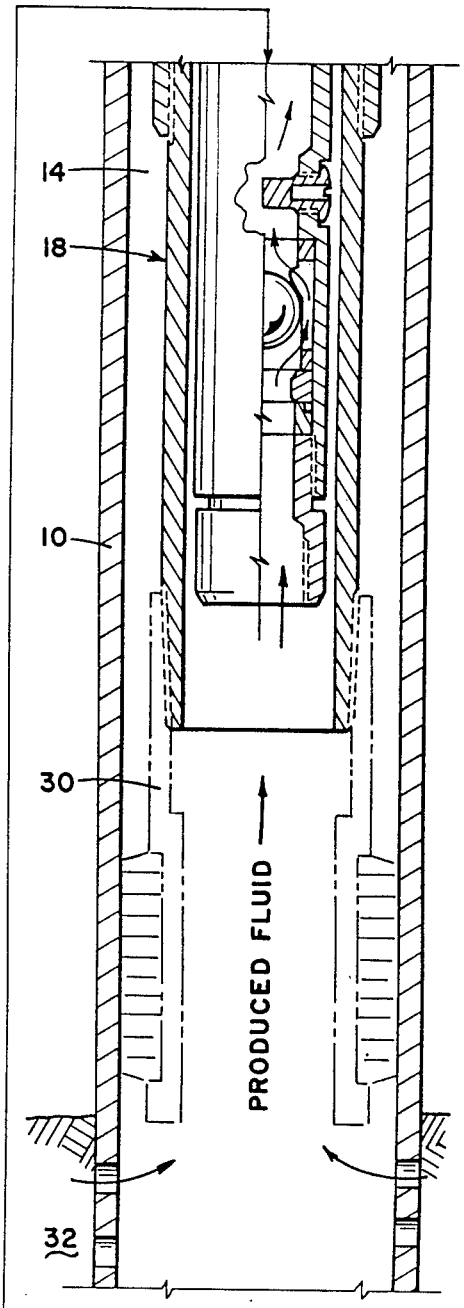

In the embodiment shown, the entire assembly is positioned and seated within the power supply tubing Wire line fishing tool and/or a retriever neck means 20 is connected to tubing 22 which connects with engine cylinder 24. Continuing downwardly in FIGS. 1B–1D, engine cylinder 24 connects with the pump cylinder 26 within which reciprocating pump piston 28 operates. The entire assembly above described is seated at the lower end of the well casing within an appropriate seating means 30 which is positioned above the oil well producing formation 32. Appropriate packers 34 and 36 are provided (see FIG. 1B) as a means to remove the assembly from the well as in the case of a free type pump. Reciprocably situated within the engine cylinder 24 is a power piston 40 (FIG. 1C) its top being 48 and bottom 50 and having appropriate seals or upper set of piston rings 42 and a special lower set of rings 44 to prevent bypass of hydraulic power fluid. Threaded below the power piston 40 is piston connector 41. A portion of the piston at 43 is of lesser diameter between the upper and lower rings 42 and 44. Without such a relief area 42, the makeup of threaded connection 45 with sleeve 47 could cause slight expansion of the outer diameter of the piston 40 into undesired frictional contact with the engine cylinder 24. Threaded sleeve 47 retains the removable and replaceable reversing valve components within the power piston 40. A power fluid passageway 46 is provided through threaded sleeve 47. As previously stated reversing valve 52 controls what is described herein as the upstroke exhaust flow passageway and the downstroke flow passageway hereinafter defined. The upstroke exhaust flow passageway is for spent or exhaust fluid to pass from above the piston during the upstroke. The passageway includes, beginning at the top, internal passageway 46, openings 54 in the threaded sleeve 47, annular space 56 between sleeve 47, orifice keeper 58 and internal wall 60 of the power piston 40. The upstroke exhaust flow passageway continues downward through a plurality of longitudinal passages 62 in reversing valve insert 63 thence across lower valve seat 64, through lower valve seat opening 66, through a plurality of longitudinal passages 68 in valve lifter insert 69 and thence into hollow rod 70 which connects the power piston with the oil well pump plunger 28. The interior of the hollow rod 70 communicates with the annular space 72 (FIG. 1D) between the pump barrel 74 and the hollow rod 70 by way of openings 76. The annular space 72 then communicates via ports 78 with the annular space 80 between the pump barrel 82 and tubing 13 which is coupled at 15 with power supply tubing 12, eventually, as shown in FIG. 1E, entering the annulus 14, along with produced fluid from the oilwell formation 32 by way of ports 84. The upward movement occurs by the flow of power fluid via annulus 98 into ports 96 upwardly in space 94 against the bottom of 50 of power piston 40. The downstroke flow passageway of this invention includes from inlet ports 96 the annular passageway 94 extending between the lower skirt and adapter 41 of the piston 40 and engine cylinder 24, ports 93 in the lower part of the engine power piston provides communication via the open upper valve seat 102 with passageway 92 of the orificed sleeve 90, thence upward through internal passageway 46 to the space above power piston 40.

Referring to FIGS. 1C, 2C and 3–7, the reversing valve mechanism is described. Threaded sleeve 47 retains the basic replaceable elements of the reversing valve in position which comprises orifice keeper sleeve 58, having inner bore 59, upper valve seat cylinder 61, with its seat 102, reversing valve insert body 63, lower valve seat 64, and valve lifter insert body 69. Orificed sleeve 90 with its orifice 92 is reciprocable in bore 59 and valve seat cylinder 61. Operable within insert body 63 is reversing valve 52 shown with an upper valve surface 103 which mates with upper seat 102, and lower valve surface 65 which mates with lower seat 64. A spiral groove 67 is provided on the body for lubrication purposes and to impart a slight rotative motion to the reversing valve 52. Below the reversing valve 52 is a hydraulic actuated valve lifter 106 having a cylindrical body portion 108 that is reciprocable within cylinder 110, the upward movement being caused by hydraulic power fluid entering the cylinder chamber 110 by way of ports 112 and 114 from annular passageway 94. A spiral groove 109 is also provided as with the reversing valve 52.

At the upper end of the engine cylinder 24 is a shift rod 116 depending downwardly into the engine cylinder and thereby being capable of entering passageway 46 of the power piston 40 as hereinafter described for causing the reversal of the movement of the piston from upstroke to downstroke.

Figure 3A:
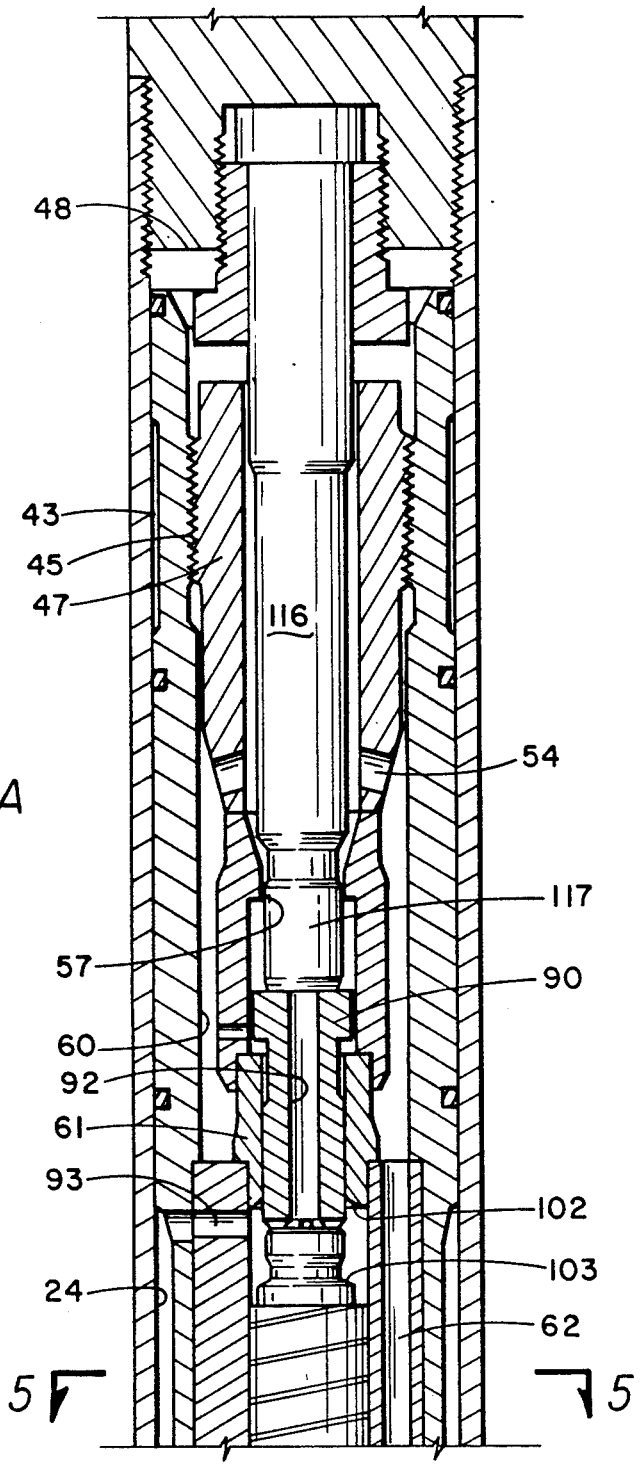
FIG. 3A is a partial sectional view of the engine and the upper part of the reversing valve of the power piston just after reaching top dead center.
Figure 3B:
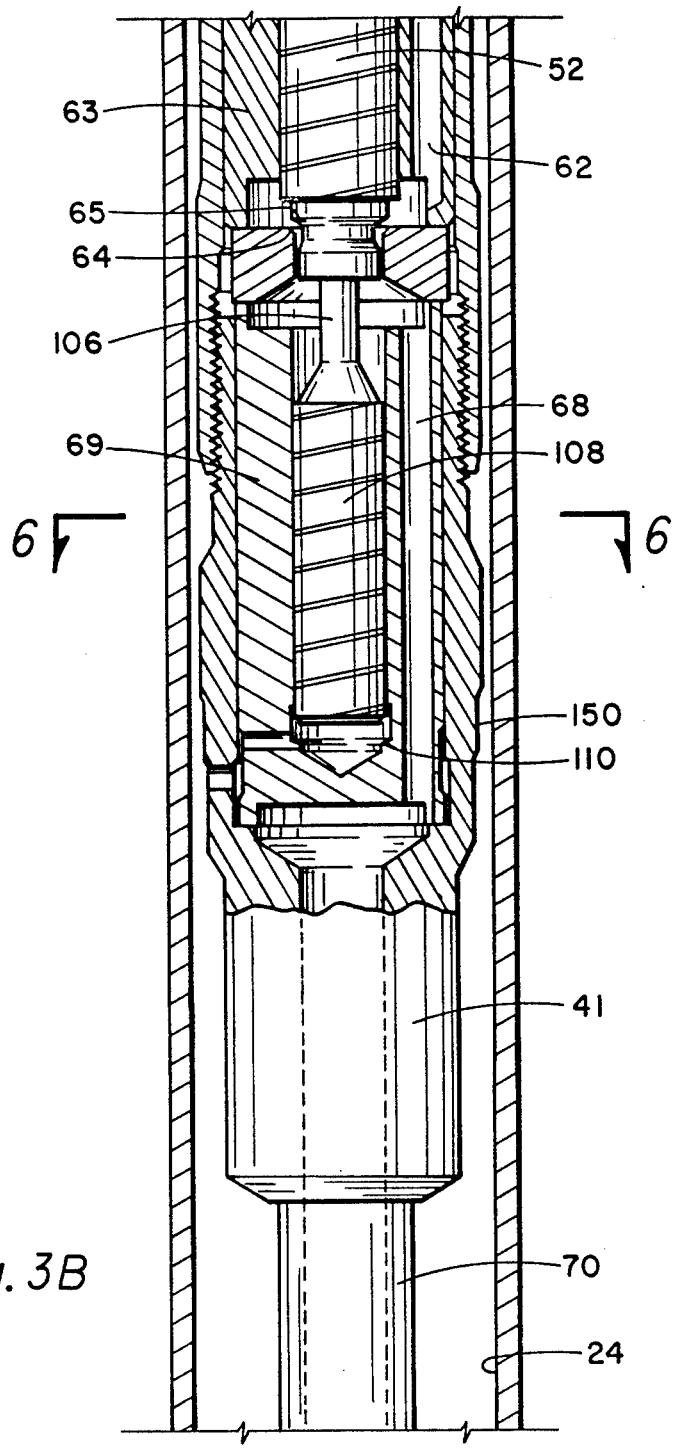
FIG. 3B is a partial sectional view and continuation of FIG. 3A of the engine and lower part of the reversing valve.
Figure 4:
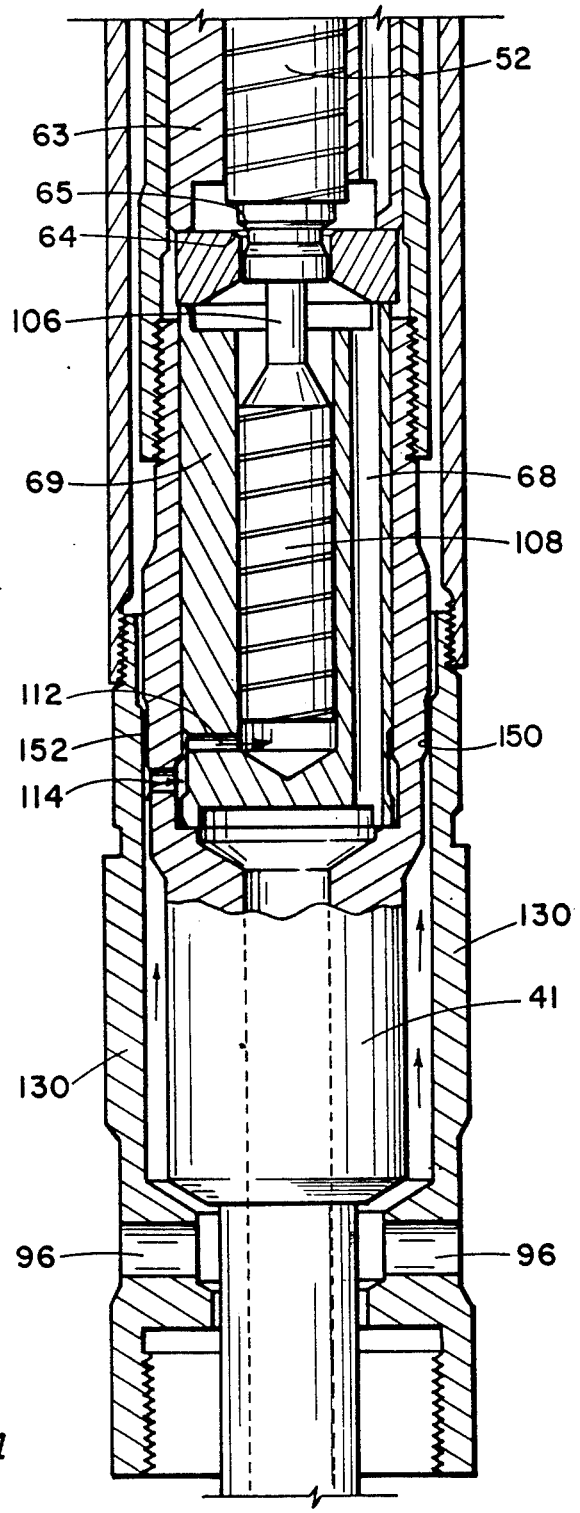
FIG. 4 is a partial lower sectional view of the engine and lower portion of the reversing valve just after reaching bottom dead center.

Referring to FIGS. 3 and 4, the stroke reversal from downstroke to upstroke occurs because of the relationship of piston-like surface 150 of connector 41 as it enters the inner confined cylindrical area defined by surface 152 of adapter 130.

The operation of the apparatus of this invention will now be described, first with regard to FIGS. 1A through 1F, which represents the position of the mechanical elements during the upstroke cycle of the engine power piston, the operation being considered to be an open power fluid type which allows the exhausted power fluid to mix with the produced fluid as distinguished from a closed power fluid system which keeps the power fluid separated from the produced fluid. As such a surface power fluid supply system schematically designated as 120 pumps power fluid into the power fluid supply tubing 12 where it enters port 122 past the open retrieval valve 21 into a crossover channel 123, thence downwardly and outwardly through ports 126 into the annular space 98 where, because of seal 124 (FIG. 1D) the power fluid enters, via ports 96, into lower adapter 130 into the annular space 94 between hollow rod 70 and the engine cylinder 24. Because flow is stopped across valve seat 102 by co-acting valve surface 103, the high pressure power fluid is operative against the bottom area 50 of the power piston 40 forcing it upwardly as shown by the large arrow. Spent power fluid previously retained above the power piston 40 is exhausted through the upstroke exhaust flow passageway via passageway 46, ports 54, annular space 56, passageways 62 in the reversing valve insert body, across open lower valve seat 64, through passageways 68 in the lifter insert body 69, thence into hollow connector 70, outwardly of ports 76 (FIG. 1D) and ultimately out via ports 78 into the space 80 where it ultimately communicates with produced fluid. The flow of produced fluid being shown by the arrows in FIGS. 1E and 1F.

Continued application of power fluid forces the power piston upwardly allowing the lower portion 117 of shift rod 116 to enter the piston internal passageway 46 and bore 57, substantially confining hydraulic fluid above the orifice sleeve 90. This confined fluid urges, without substantial metal to metal contact, the orifice sleeve 90 downward. In the event the upward movement of the engine power piston is slow, and the fluid escapes, the shift rod slowly urges the orifice sleeve downward mechanically. As the reversing valve 52 and its upper valve surface 103 leaves the upper seat 102 of the upper valve seat cylinder 61, the differential hydraulic pressure acting thereon forces the reversing valve 52 and the valve lifter 106, downward to a position where the reversing valve lower surface 65 will seat on lower valve seat 64 and thus shut off flow through the heretofore described upstroke exhaust flow passageway.

Figure 2A:
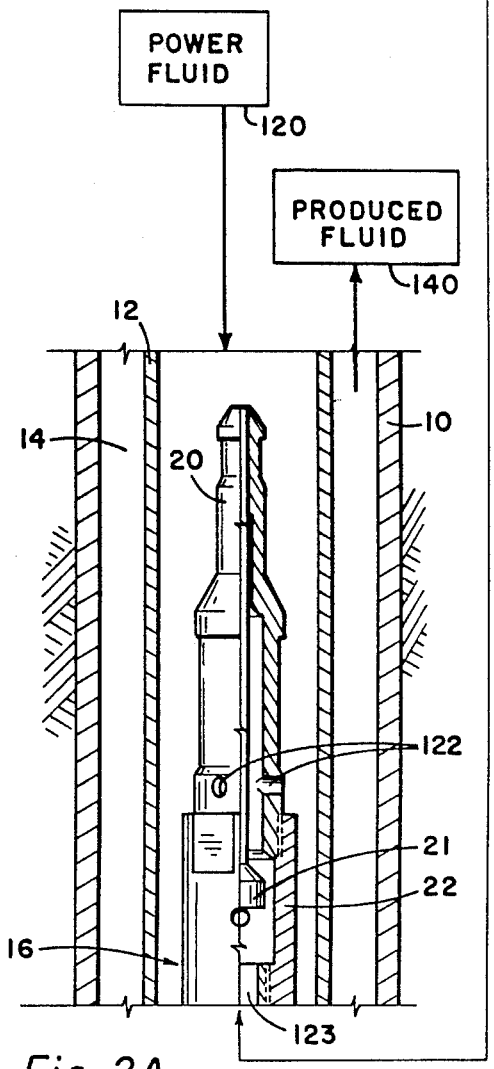
FIGS. 2A through 2F are longitudinal cross sectional representations of the hydraulic down hole pump of this invention showing the reversing valve in the downstroke position.
Figure 2B:
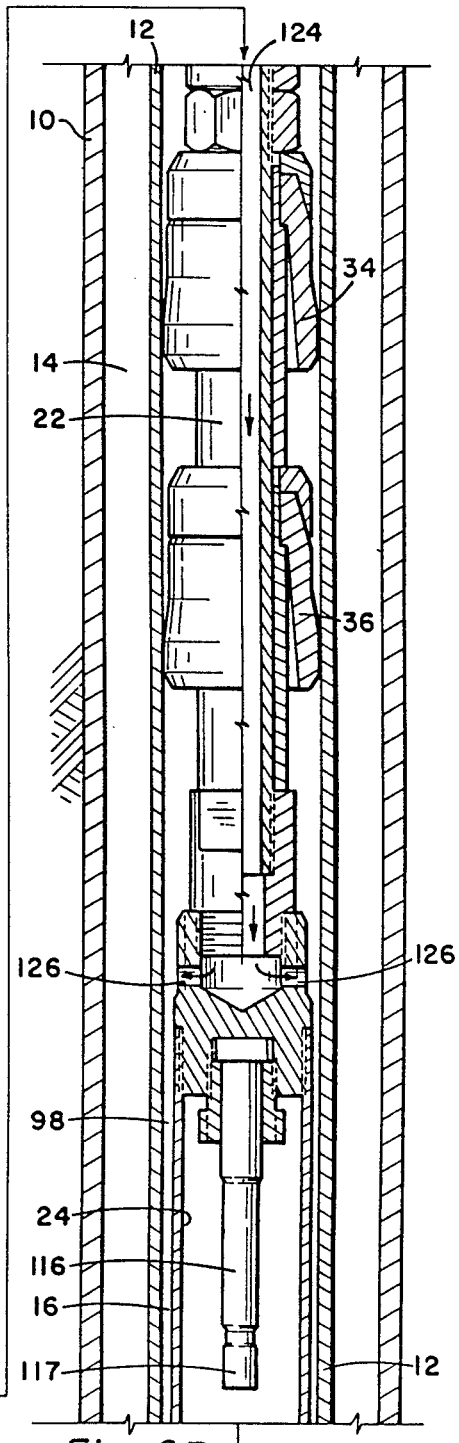
Figure 2C:
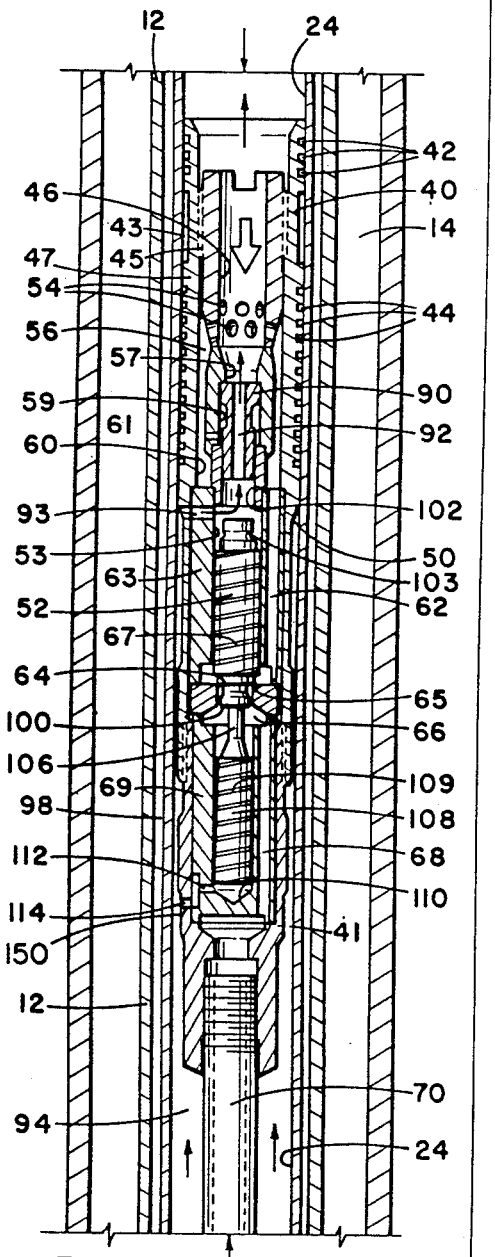
Figure 2D:
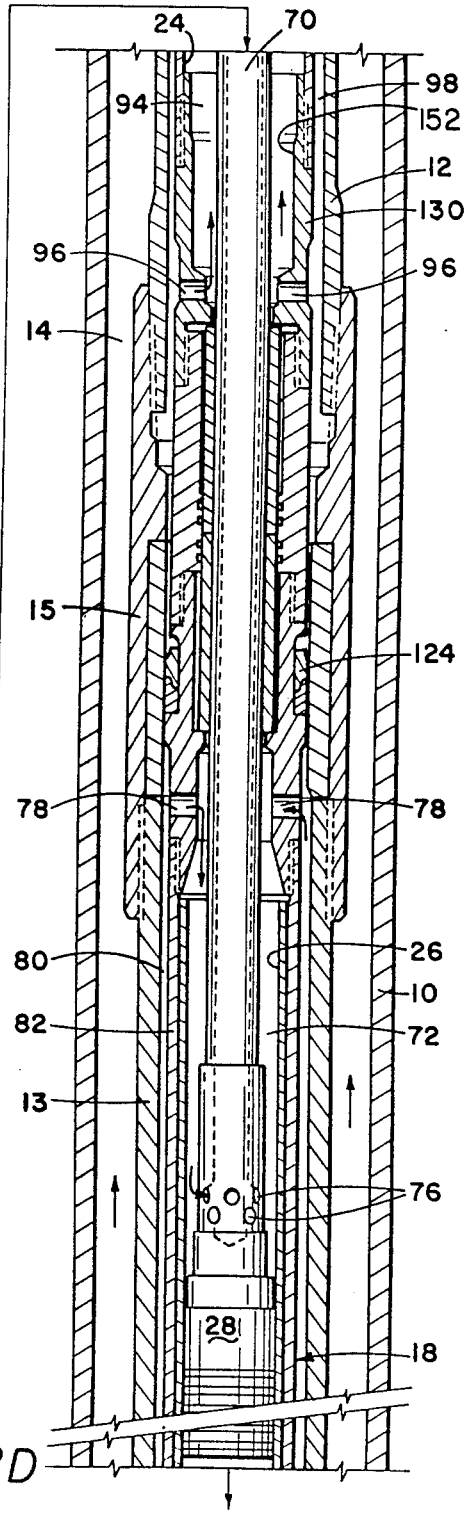
Figures 2E, 2F:
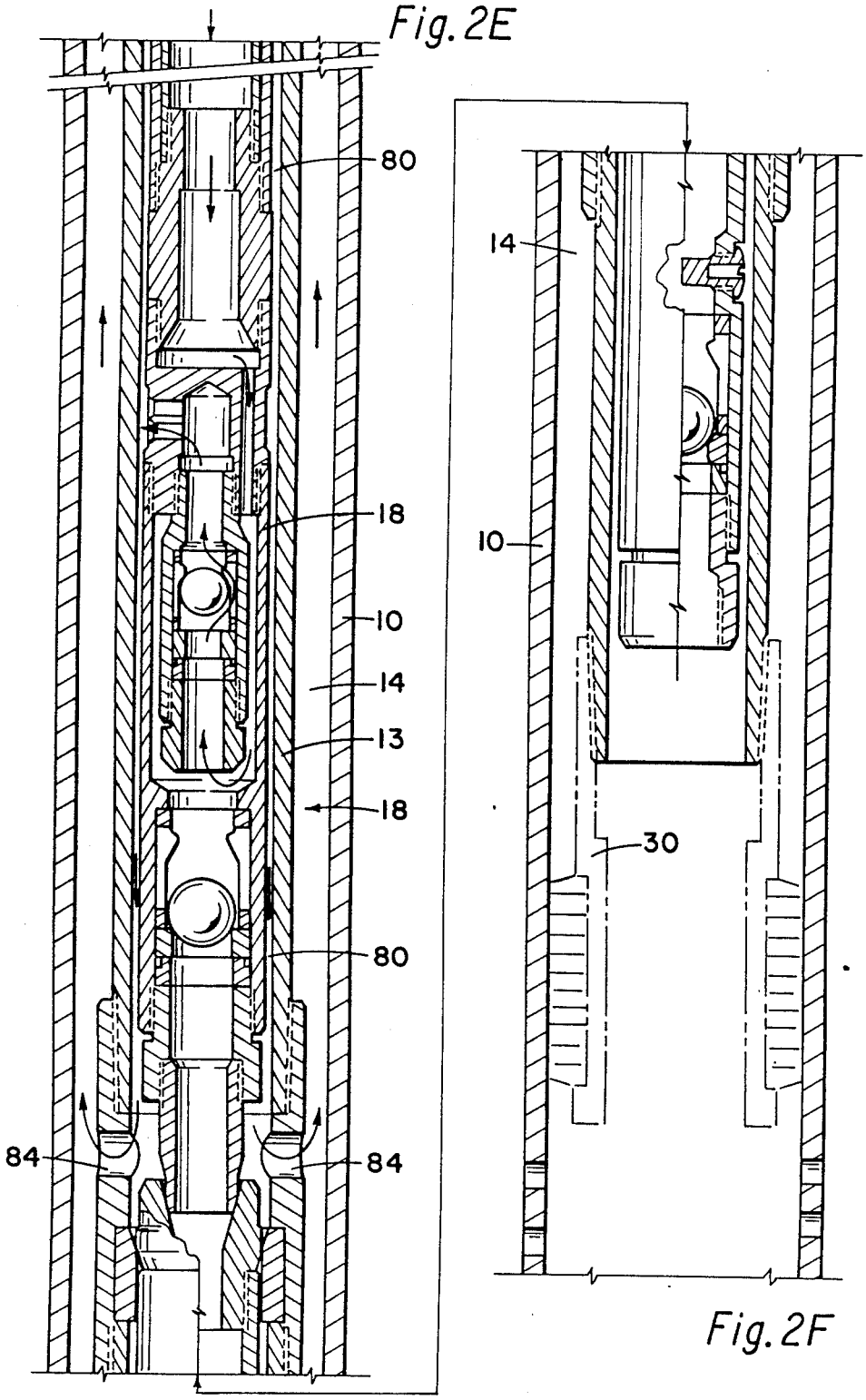

As shown in FIG. 3 because the downstroke flow passage is now open via ports 93, across open valve seat 102 the downstroke cycle begins as shown by the large arrow in FIG. 2C. Referring to FIG. 2C, power fluid continues through orifice 92 in the orifice in sleeve 90, upwardly through the passageway 46 and there into the cylinder chamber above the top of power piston 48 forcing same downward. The high pressure power fluid is now below and above the engine and because of the differential areas of the power piston, the piston is caused to move downward. FIGS. 2E and 2F describe the flow of produced fluid and spent power fluid during the downstroke. The downstroke proceeds until the power piston extension connector 41 enters the engine barrel adapter 130 as described in FIG. 4. Because of the close fit of surface 150 in cylinder like surface 152 of the adapter 41, high pressure power fluid is somewhat confined within the annular space 94 therebelow which enters via passageway 114 and 112, into the valve lifter chamber 110 below the valve lifter causing it to be urged upward opening the lower valve seat 64 and closing the upper valve seat 102. The engine is now in configuration as per FIG. 1 to make its upstroke.

Figure 5:
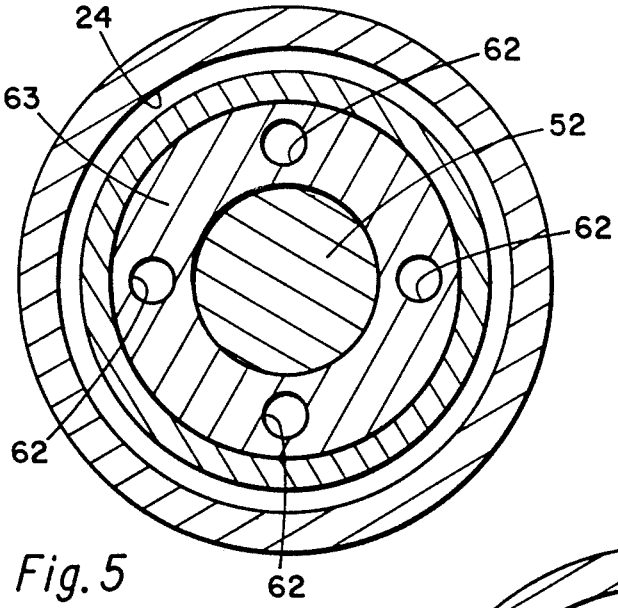
FIG. 5 is a sectional view taken along the line 5—5 of FIG. 3.
Figure 6:
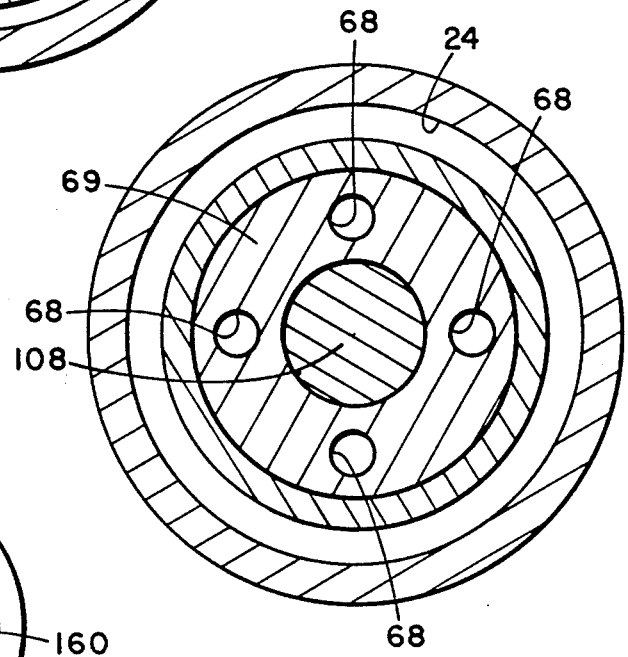
FIG. 6 is a sectional view taken along the line 6—6 of FIG. 3.

FIGS. 5 and 6 are added to show the concept of providing replaceable insert body 63 for the reversing valve and replaceable insert body 69 for the valve lifter, making repair and replacement much simpler without complete replacement of a total piston assembly as has been done in the art.

Figure 7:
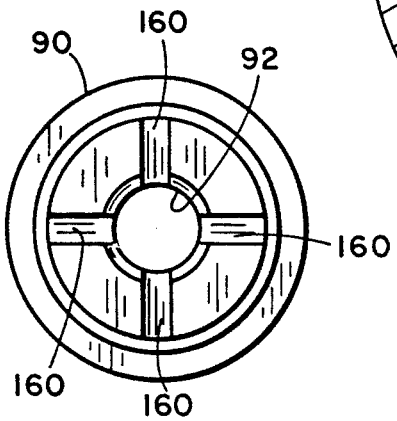
FIG. 7 is a bottom view of the orificed sleeve.

FIG. 7 is a bottom view of the orifice sleeve 90 to show the flow groove 160 provided at the bottom thereof.

What is claimed:

1. A hydraulic power fluid actuated engine for reciprocating an oil well pump, said pump having a reciprocable pump piston, said engine comprising:

an engine cylinder;

a power piston reciprocably received within said cylinder, said piston having an upstroke exhaust flow passageway and lower valve seat, said upstroke exhaust flow passageway capable of communicating power fluid to below said power piston;

a reciprocable reversing valve means having a lower valve surface near a bottom end to close the flow of power fluid through said upstroke exhaust flow passageway; and a valve lifter reciprocably positioned below said reversing valve, said lifter having means to impart a slight rotation during reciprocation thereof.

2. A hydraulic power fluid actuated engine for reciprocating an oil well pump, said pump having a reciprocable pump piston, said engine comprising:

an engine cylinder;

a power piston reciprocably received within said cylinder, said piston having an upstroke exhaust flow passageway and lower valve seat, said upstroke exhaust flow passageway capable of communicating power fluid to below said power piston, said piston also having a downstroke internal flow passageway and upper valve seat, said downstroke internal flow passageway capable of communicating power fluid to above said power piston;

a reciprocable reversing valve means having a lower valve surface near a bottom end to close the flow of power fluid through said upstroke exhaust flow passageway, an upper valve surface near a top end to close the flow of power fluid through said downstroke internal flow passageway, and said reversing valve means also having means to impart a slight rotation during reciprocation thereof; and a valve lifter reciprocably positioned below said reversing valve, said lifter having means to impart a slight rotation during reciprocation thereof.

3. A hydraulic power fluid actuated engine for reciprocating an oil well pump, said pump having a reciprocable pump piston, said engine comprising:

an engine cylinder;

an upstroke and downstroke power piston reciprocable received within said cylinder, said piston having an upstroke exhaust flow passageway and lower valve seat, said upstroke exhaust flow passageway capable of communicating power fluid to below said power piston;

a hollow rod means connecting the bottom of said power piston with said pump piston, the interior or said rod in communication with said upstroke exhaust flow passageway, port means above said pump piston near the lower end of said rod for communicating the flow of exhaust fluid from said interior of said rod;

a reciprocable reversing valve means having a lower valve surface near a bottom end to close the flow of power fluid through said upstroke exhaust flow passageway; and a hydraulic activated valve lifter reciprocably positioned below said reversing valve, port means to communicate high pressure power fluid below said valve lifter to unseat said lower valve surface from said lower valve seat near the end of the downstroke.

4. A hydraulic power fluid actuated engine for reciprocating an oil well pump, said pump having a reciprocable pump piston, said engine comprising:

an engine cylinder;

a power piston reciprocable received within said cylinder, said piston having a downstroke flow passageway and upper valve seat, said downstroke flow passageway capable of communicating power fluid to above said power piston;

a reciprocable reversing valve means having an upper valve surface near a top end to close said seat and the flow of power fluid through said downstroke flow passageway;

an orificed sleeve positioned in an orifice keeper above said reversing valve; and a shift rod means depending near the top of said cylinder and adapted to be received within said orifice keeper to provide hydraulic pressure for unseating said upper valve surface from said upper valve seat.

5. A hydraulic power fluid actuated engine for reciprocating an oil well pump, said pump having a reciprocable pump piston, said engine comprising:

an engine cylinder;

a power piston reciprocably received within said cylinder, said piston having an upstroke exhaust flow passageway and lower valve seat, said upstroke exhaust flow passageway capable of communicating power fluid to below said power piston, said piston also having a downstroke internal flow passageway and upper valve seat, said downstroke internal flow passageway capable of communicating power fluid to above said power piston;

a reciprocable reversing valve means having a lower valve surface near a bottom end to close the flow of power fluid through said upstroke exhaust flow passageway, said reversing valve means also having an upper valve surface near a top end to close the flow of power fluid through said downstroke internal flow passageway;

a reversing valve insert body having an interior cylinder to reciprocably receive said reversing valve means, a longitudinal passageway forming part of said upstroke-exhaust flow passageway, port means near a top end forming part of said downstroke internal flow passageway;

a valve lifter reciprocably positioned below said reversing valve; and a valve lifter insert body having an interior cylinder to reciprocably receive said valve lifter, a longitudinal passageway forming part of said upstroke exhaust flow passageway, port means to communicate power fluid to the lower end of said valve lifter.

6. A hydraulic power fluid actuated engine for reciprocating an oil well pump, said pump having a reciprocable pump piston, said engine comprising:

an engine cylinder;

a power piston reciprocably received within said cylinder, said piston having an upstroke exhaust flow passageway and lower valve seat, said upstroke exhaust flow passageway capable of communicating power fluid to below said power piston, said piston also having a downstroke internal flow passageway and upper valve seat, said downstroke internal flow passageway capable of communicating power fluid to above said power piston;

a reciprocable reversing valve means having a lower valve surface near a bottom end to close the flow of power fluid through said upstroke exhaust flow passageway, an upper valve surface near a top end to close the flow of power fluid through said downstroke internal flow passageway, and said reversing valve means also having means to impart a slight rotation during reciprocation thereof.

7. A hydraulic power fluid actuated engine for reciprocating an oil well pump, said pump having a reciprocable pump piston, said engine comprising power fluid supply tubing;

an engine cylinder with said tubing;

a power piston reciprocably received within said cylinder, said piston having a downstroke flow passageway controlled by an upper valve seat, and an upstroke exhaust flow passageway controlled by a lower valve seat, both said passageways capable of communicating power fluid to above and below said power piston;

a hollow rod means connecting the bottom of said power piston with the top of said pump piston, the interior of said rod in communication with said upstroke exhaust flow passageway, port means about said pump piston at a lower end of said rod for communicating the flow of fluid between said interior of said rod with fluid produced from said oil well;

a reciprocable reversing valve means having means at a top end to control the flow of power fluid through said downstroke flow passageway and having means at a bottom end to interrupt the flow of power fluid through said upstroke exhaust flow passageway; and an orificed sleeve positioned in an orifice keeper above said downstroke internal valve seat;

a shift rod means depending at the top of said cylinder and adapted to be received within said orifice keeper at the top of said upstroke of said power piston to provide hydraulic pressure against said orificed sleeve and a hydraulic activated valve lifter reciprocably positioned below said upflow valve seat, means communicating said power fluid against said valve lifter, and means to supply said power fluid through said supply tubing into communication with said cylinder below said power piston.

8. The engine of claim 7 wherein said reversing valve means comprises, within said power piston, a cylindrical bore to receive the following parts:

(a) a first insert body, said body having a plurality of longitudinal passageways, an interior cylinder, a valve piston and lifter means reciprocable within said cylinder, port means adjacent the bottom of said cylinder to provide communication with high pressure power fluid;

(b) a lower valve seat above said first insert body;

(c) a second insert body, said body having a plurality of longitudinal passages, an interior cylinder, a reversing valve piston means reciprocable within said interior cylinder, said reversing valve comprising a lower valve surface means to seat with said lower valve seat, and an upper valve surface means, port means adjacent the top of said cylinder to provide communication with high pressure power fluid with the interior of said cylinder of said second insert body;

(d) an upper valve seat above said second insert body to seat with said upper valve surface of said reversing valve;

(e) an orifice keeper above said upper valve seat;

(f) an orificed sleeve reciprocable within said upper valve seat and said orifice keeper;

(g) a sleeve threaded to said piston, said sleeve having an axial passageway, and a plurality of ports for flow of fluid from said axial passageway to an upstroke exhaust flow passageway defined by the plurality of longitudinal passages in said second insert body, across said lower seat, through said longitudinal passage in said first insert body into a hollow rod connecting the bottom of said piston with said reciprocable pump piston, thence outward into ultimate communication with fluids produced by said oil well pump, said threaded sleeve adapted to retain all of said parts within said cylindrical bore of said power piston; and (h) means to supply power fluid to said engine cylinder space below said power piston.

9. A hydraulic power fluid actuated engine for reciprocating an oil well pump, said pump having a reciprocable pump piston, said engine comprising:

an engine cylinder;

a power piston reciprocably received within said cylinder, said piston having an upstroke exhaust flow passageway and lower valve seat, said upstroke exhaust flow passageway capable of communicating power fluid to below said power piston, said piston also having a downstroke internal flow passageway and upper valve seat, said downstroke internal flow passageway capable of communicating power fluid to above said power piston;

a hollow rod means connecting the bottom of said power piston with the said pump station, the interior of said rod in communication with said upstroke exhaust flow passageway; port means above said pump piston near the lower end of said rod for communicating the flow of exhaust fluid from said interior of said rod;

a reciprocable reversing valve means having a lower valve surface near a bottom end to close the flow of power fluid through said upstroke exhaust flow passageway, said reversing valve means also having an upper valve surface near a top end to close the flow of power fluid through said downstroke internal flow passageway;

a hydraulic activated valve lifter reciprocably positioned below said reversing valve, port means to communicate high pressure power fluid below said valve lifter to unseat said lower valve surface from said lower valve seat near the end of the downstroke;

an orificed sleeve positioned in an orifice keeper above and contiguous to the top of said reversing valve; and a shift rod means depending near the top of said cylinder and adapted to be received within said orifice keeper to provide hydraulic pressure against said orificed sleeve for unseating said upper valve surface of said reversing valve from said upper valve seat.

10. The engine of claim 9 wherein said shift rod means provides hydraulic and/or mechanical pressure against said orificed sleeve.

11. A hydraulic power fluid actuated engine for reciprocating an oil well pump, said pump having a reciprocatable pump piston, said engine comprising an engine cylinder;

a power piston reciprocably received within said cylinder, said piston having a downstroke flow passageway controlled by an upper valve seat, and an upstroke exhaust flow passageway controlled by a lower valve seat, both said passageways capable of communicating power fluid to above and below said power piston;

a reciprocable reversing valve means having means at a top end to control the flow of power fluid through said downstroke flow passageway and having means at a bottom end to control the flow of power fluid through said upstroke exhaust flow passageway; and a hydraulic power fluid actuated reversing valve filter reciprocably positioned below said reversing valve.

12. The engine of claim 11 wherein said reversing valve includes a spiral groove about its periphery.

13. The engine of claim 11 wherein said valve lifter includes a spiral groove about its periphery.

14. The engine of claim 11 wherein each said reversing valve and said valve lifter include a spiral groove about their peripheries.

15. The engine of claim 11 wherein said reversing valve is operative within a bore of a removable insert sleeve, said sleeve having at least one longitudinal passageway forming part of said upstroke exhaust flow passageway and port means near a top of said sleeve forming part of said downstroke flow passageway.

16. The engine of claim 15 wherein said reversing valve includes a spiral groove about its periphery.

17. The engine of claim 11 or 15 wherein said valve lifter is operative within a bore of a removable insert sleeve, said sleeve having at least one longitudinal passageway forming part of said upstroke exhaust flow passageway and port means to communicate power fluid to a lower end of said valve lifter.

18. The engine of claim 17 wherein said valve lifter includes a spiral groove about its periphery.

* * * * *